US009635990B2

(12) United States Patent
Fellhauer

(10) Patent No.: US 9,635,990 B2
(45) Date of Patent: May 2, 2017

(54) FLOOR CLEANING OR BURNISHING MACHINE PIVOT SUSPENSION

(71) Applicant: NSS Enterprises, Inc., Toledo, OH (US)

(72) Inventor: Jeffery R. Fellhauer, Toledo, OH (US)

(73) Assignee: NSS Enterprises, Inc., Toledo, OH (US)

( * ) Notice: Subject to any disclaimer, the term of this patent is extended or adjusted under 35 U.S.C. 154(b) by 0 days.

(21) Appl. No.: 14/943,114

(22) Filed: Nov. 17, 2015

(65) Prior Publication Data

US 2016/0249779 A1 Sep. 1, 2016

Related U.S. Application Data

(60) Provisional application No. 62/081,082, filed on Nov. 18, 2014.

(51) Int. Cl.
*A47L 11/10* (2006.01)
*A47L 11/40* (2006.01)
*A47L 11/162* (2006.01)

(52) U.S. Cl.
CPC ..... *A47L 11/4072* (2013.01); *A47L 11/162* (2013.01)

(58) Field of Classification Search
CPC ..... A47L 11/10; A47L 11/4072; A47L 11/02
See application file for complete search history.

(56) References Cited

U.S. PATENT DOCUMENTS 3,481,417 A 12/1969 Jarret et al.
3,893,530 A 7/1975 Gordon
4,044,848 A 8/1977 Wilkins
4,511,825 A 4/1985 Klimo
4,709,771 A 12/1987 Basham et al.
(Continued)

FOREIGN PATENT DOCUMENTS

DE 4323332 A1 1/1995
DE 4342496 A1 6/1995
(Continued)

OTHER PUBLICATIONS

International Search Report and Written Opinion for Application No. PCT/US2016/013776, mailing date Apr. 5, 2016; issued by the European Patent Office.
(Continued)

*Primary Examiner* — Shay Karls
(74) *Attorney, Agent, or Firm* — Marshall & Melhorn, LLC

(57) ABSTRACT

A pivot suspension has two separate wheels and a channel, which has two ends axially extending across a floor cleaning or burnishing machine. One wheel is attached to a first end of the channel and the other wheel is attached to a second end of the channel. The pivot suspension further has a pivot rod that is pivotably attached to and is in line from front to rear with the machine. The pivot rod is fixedly connected to the channel at a location between the two channel ends. As a result, the wheels and channel are pivotably attached to the machine, by way of the pivot rod. In combination with at least one wheel or caster that is attached to a frame of the machine, the two channel wheels form three points of contact with a floor, even if there is dirt, debris, and unevenness on or in the floor.

3 Claims, 3 Drawing Sheets

(56) References Cited

U.S. PATENT DOCUMENTS

| | | | | |
|---|---|---|---|---|
| 4,825,500 | A | 5/1989 | Basham et al. | |
| 4,953,645 | A | 9/1990 | Koerber et al. | |
| 4,986,378 | A | 1/1991 | Kasper | |
| 5,022,476 | A | 6/1991 | Weege | |
| 5,044,043 | A | 9/1991 | Basham et al. | |
| 5,064,010 | A | 11/1991 | Masbruch et al. | |
| 5,253,724 | A | 10/1993 | Prior | |
| 5,740,887 | A | 4/1998 | Unger et al. | |
| 5,743,347 | A | 4/1998 | Gingerich | |
| 5,923,096 | A | 7/1999 | Manak | |
| 6,089,341 | A * | 7/2000 | Gingerich | B60L 8/00 180/2.2 |
| 6,095,268 | A | 8/2000 | Jones, Jr. | |
| 6,202,773 | B1 | 3/2001 | Richey, II et al. | |
| 6,386,305 | B2 | 5/2002 | Nakakita et al. | |
| 6,457,206 | B1 | 10/2002 | Judson | |
| 6,526,336 | B2 | 2/2003 | Strothmann | |
| 6,615,937 | B2 | 9/2003 | Richey, II et al. | |
| 6,672,412 | B1 | 1/2004 | Charlson | |
| 6,776,249 | B2 | 8/2004 | Fortin | |
| 7,041,029 | B2 | 5/2006 | Fulghum et al. | |
| 7,138,772 | B2 | 11/2006 | Noro et al. | |
| 7,172,041 | B2 | 2/2007 | Wuertz et al. | |
| 7,533,435 | B2 | 5/2009 | Pedlar et al. | |
| 7,703,166 | B2 * | 4/2010 | Raddick | A47L 11/03 118/323 |
| 7,730,980 | B2 | 6/2010 | Mayer et al. | |
| 8,678,883 | B2 | 3/2014 | Strickland | |
| 2005/0132527 | A1 | 6/2005 | Pedlar et al. | |
| 2005/0223514 | A1 | 10/2005 | Stuchlik et al. | |
| 2005/0239594 | A1 | 10/2005 | Fulghum et al. | |
| 2005/0247508 | A1 | 11/2005 | Gilliland et al. | |
| 2008/0184687 | A1 * | 8/2008 | Scherbring | A01D 34/64 56/10.1 |
| 2009/0094784 | A1 | 4/2009 | Pedlar et al. | |
| 2009/0198414 | A1 | 8/2009 | Mohning et al. | |
| 2009/0260901 | A1 | 10/2009 | Ishii et al. | |
| 2009/0288685 | A1 | 11/2009 | Wolfe et al. | |
| 2013/0292146 | A1 | 11/2013 | Fellhauer et al. | |
| 2014/0093345 | A1 | 4/2014 | Nakazawa et al. | |

FOREIGN PATENT DOCUMENTS

| | | | |
|---|---|---|---|
| DE | 19503615 | A1 | 8/1995 |
| EP | 0404437 | A1 | 12/1990 |
| EP | 0951857 | A1 | 10/1999 |
| EP | 1319577 | A2 | 6/2003 |
| EP | 2387931 | A2 | 11/2011 |
| GB | 1360261 | | 7/1974 |
| GB | 2223333 | A | 4/1990 |
| GB | 2342903 | A | 4/2000 |
| JP | S62177203 | U | 11/1987 |
| JP | 2001104396 | A | 4/2001 |
| JP | 2002149257 | A | 5/2002 |
| JP | 2002283906 | A | 10/2002 |
| WO | 9423683 | A1 | 10/1994 |
| WO | 0024305 | A1 | 5/2000 |
| WO | 2006051105 | A1 | 5/2006 |
| WO | 2011057080 | A1 | 5/2011 |

OTHER PUBLICATIONS

Curtesy machine-generated English translation of EP2387931A2 obtained via Espacenet Patent Search (URL:http://worldwide.espacenet.com/?locale=en_EP) on Apr. 15, 2016.

* cited by examiner

FLOOR CLEANING OR BURNISHING MACHINE PIVOT SUSPENSION

RELATED APPLICATIONS

This application claims the benefit, under 35 U.S.C. §119(e), of U.S. Provisional Patent Application Ser. No. 62/081,082, filed Nov. 18, 2014 under 35 U.S.C. §111(b), which application is incorporated herein in its entirety.

FIELD OF THE INVENTION

The present invention relates to a floor cleaning or burnishing machine suspension.

BACKGROUND OF THE INVENTION

Floor cleaning or burnishing machines are either a walk-behind or a ride-on type that are operated for vacuuming, sweeping, buffing, stripping, scrubbing and cleaning. These machines operate on generally level and on uneven floors, where, for example, bumps, dirt and/or objects can be present. Typically, wheels or casters associated with these machines are axially aligned, for example, across the floor cleaning or burnishing machine from one another. In some cases, the wheels may be mounted on a common axle. Alternately, the wheels or casters can be attached to the machine without a common axle connecting them.

Regardless of whether wheels or casters are used and their alignment, an uneven floor, dirt/debris, or objects on the floors, can cause the machines to operate improperly. For example, if one of two aligned rear wheels becomes misaligned horizontally above or below the other wheel, one of the wheels may grip the floor or an object on the floor, while the grip of another wheel may be diminished or the wheel may merely spin, thereby only two wheels and/or casters may make significant contact. As a result, the machine can tip or move in a direction that is not desired, thus causing injury to the operator or other individuals, and may cause physical damage to a facility or products.

Therefore, what is sought is a suspension for a floor cleaning or burnishing machine that can compensate for misalignment of wheels, uneven floors, and debris, while making a three point contact with a floor. As a result, such a suspension would protect against the machine tipping, bursting forward or reverse, or being misdirected, so as to prevent injury to the operator or other individuals, while avoiding causing physical damage to a facility or products.

SUMMARY OF THE INVENTION

A floor cleaning or burnishing machine pivot suspension has at least two separate wheels and a channel, where the channel has two ends that axially extend across a floor cleaning or burnishing machine. One wheel is rotatably attached to a first end of the channel and a second wheel is rotatably attached to a second end of the channel. The floor cleaning or burnishing machine pivot suspension further comprises a pivot rod that is in line with the front to the rear of the floor cleaning or burnishing machine and is fixedly connected to the channel at a location between the two ends of the channel. Further, the pivot rod is pivotably connected to a frame of the floor cleaning or burnishing machine, which has at least one caster or wheel disposed thereon. As a result of the pivot suspension, the two wheels disposed on the channel, in combination with the at least one caster or wheel on the frame, form three points of contact with a floor, even if there is dirt, debris, and unevenness on or in the floor.

Further objects and advantages of the present invention will be apparent from the following description and appended claims, reference being made to the accompanying drawings forming a part of a specification, wherein like reference characters designate corresponding parts of several views.

BRIEF DESCRIPTION OF THE DRAWINGS

The advantages of the present invention will become readily apparent to those skilled in the art from the following detailed description when considered in light of the accompanying drawings in which.

Further aspects of the present invention, together with the organization and operation thereof, will become apparent from the following detailed description of the invention when taken in conjunction with the accompanying drawings.

DETAILED DESCRIPTION OF THE INVENTION

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1:
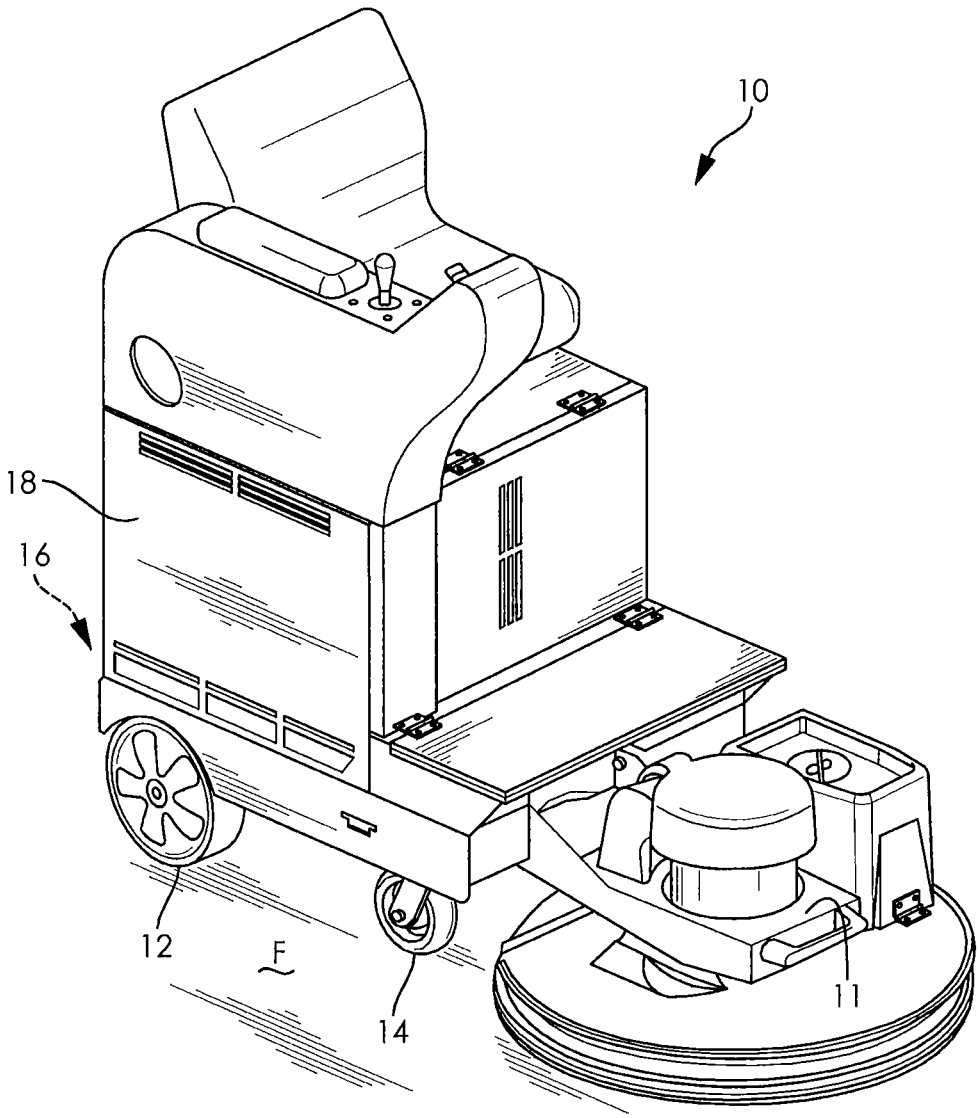
FIG. 1 is a three dimensional isometric view of a floor cleaning or burnishing machine in accordance with the present invention.
Figure 2:
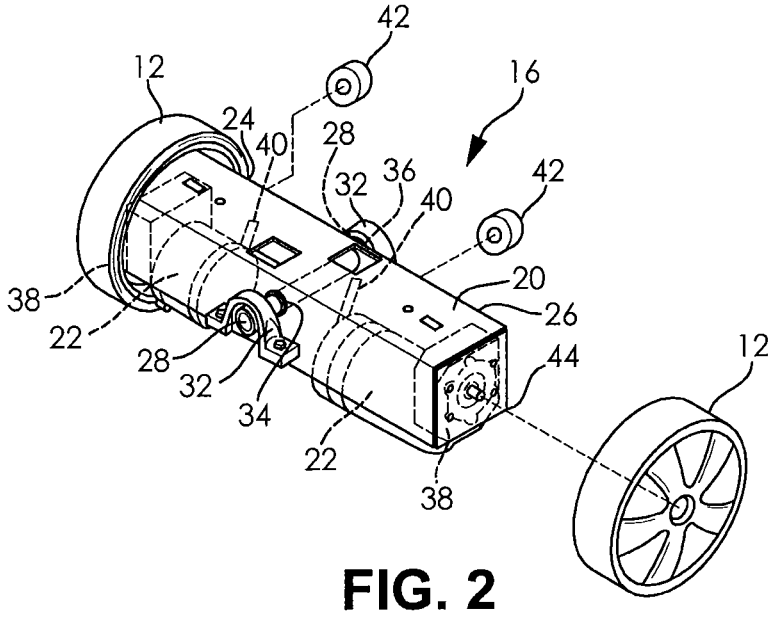
FIG. 2 is a three dimensional isometric view of a pivot suspension for the floor cleaning or burnishing machine of FIG. 1, in an upside down position.
Figure 3:
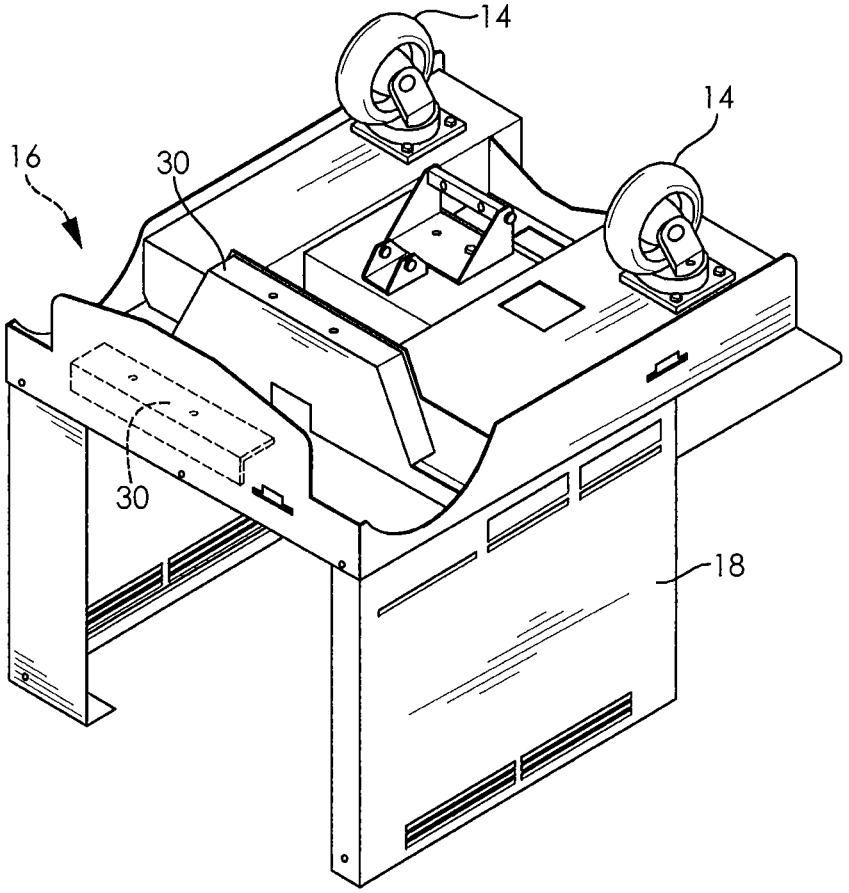
FIG. 3 is a three dimensional isometric view of a lower cabinet frame of the floor cleaning or burnishing machine of FIG. 1, in an upside down position.
Figure 4:
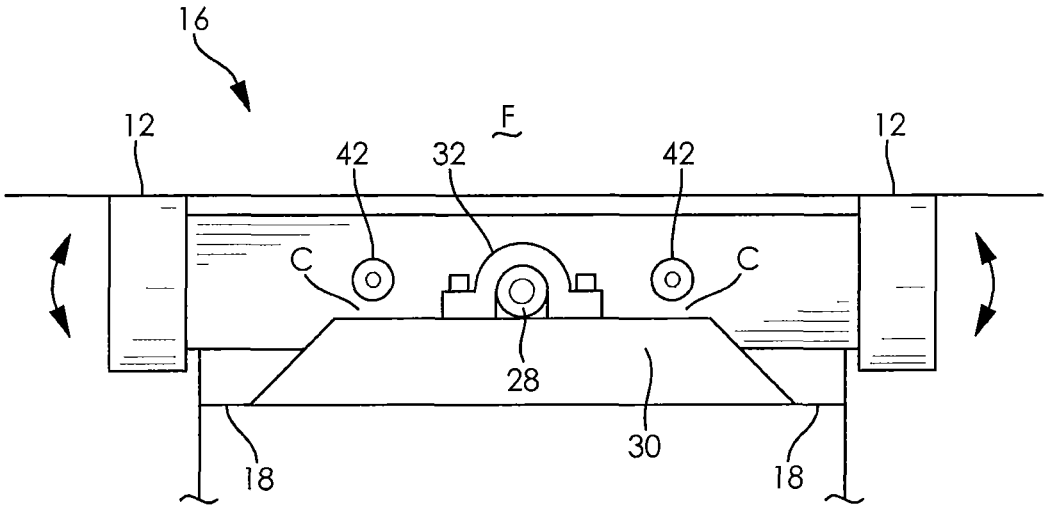
FIG. 4 is a frontal plan view of the pivot suspension of FIG. 2, in an upside down position.

In general, FIG. 1 illustrates a floor cleaning or burnishing machine 10 having a floor cleaner or burnisher 11, at least two separate wheels 12, one or more casters 14, and a pivot suspension 16, all of which are disposed on the underside of the floor cleaning or burnishing machine 10, as FIGS. 2-4 best illustrate. Specifically, the pivot suspension 16 comprises the two separate wheels 12 and a channel 20. The channel 20 is shown having a rectangular cross-section that laterally extends, which could be continuously, across the floor cleaning or burnishing machine 10. The channel 20 may take other cross-sectional forms, for example, triangular and circular. Also, the channel 20 is generally hollow for allowing items, possibly unrelated items, to be fixedly mounted therein or disposed therethrough, for example, wiring.

Each of the four lateral walls that make up the channel 20 are typically made of metal and have the same lateral width. If the channel 20 has a rectangular cross-section, as shown in FIG. 2, then two opposing walls share a first height and the other two opposite walls share a second height. As illustrated, the channel 20 has open ends 24, 26 that are available for mounting drive items, like separate gear boxes 38 discussed below.

Specifically, two separate drive motors 22 are fixedly mounted by way of, for example, bolts (not shown but common in the art), within the respective open ends 24, 26 of the channel 20. Each drive motor 22 drives the separate gear boxes 38 that are fixedly mounted thereto, which in turn drives a respective wheel 12. Thereby, the floor cleaning or burnishing machine 10 is controlled moving forward, backward, and to the right or to the left, as detailed in U.S. patent application Ser. Nos. 13/874,581 and 14/603,463. Although shown disposed on the inside ends of the channel 20, the gear boxes 38 may be dispose on the outside ends of the channel 20.

For maintenance purposes, each motor 22 has a manually operated brake lever 40 that locks and unlocks the rotor within the motor 22. Thereby, the manually operated brake lever 40 provides safety to maintenance personnel during mounting and dismounting various parts of the pivot suspension 16 from the channel 20.

The pivot suspension 16 also has a pivot rod 28, which may be continuous, as shown, that is pivotably connected to underbody brackets 30 of the floor cleaning or burnishing machine 10, by way of being mounted within pillow block bearings 32. FIG. 2 illustrates this mounting by way of two dashed lines within the pivot suspension 16, between the pillow block bearings 32. The pillow block bearings 32 are fixedly attached, by means common in the art, for example, bolts, to the underbody brackets 30, as shown in FIG. 4. The underbody brackets 30 are fixedly attached, for example, by way of welding, to a floor cleaning or burnishing machine frame 18 of the floor cleaning or burnishing machine 10. The pivot rod 28 is disposed in line, from the forward direction to the rear direction of the floor cleaning or burnishing machine 10, and fixedly attached, for example, by being welded to the channel 20 at rear location 34 and front location 36. These channel locations 34, 36 are generally midway between the two ends 24, 26 of the channel 20.

Hence, the continuous pivot rod 28, the channel 20, the motors 22, the gear boxes 38, and the wheels 12, are in a pivotable relationship with the floor cleaning or burnishing machine frame 18 of the of the floor cleaning or burnishing machine 10, by way of the pillow block bearings 32, thereby forming the pivot suspension 16. As seen in FIGS. 2 and 4, rubber or plastic stops 42, which are located on the channel 20. These stops 42 limit the pivoting of the pivot suspension 16 at points C to approximately ±10° horizontally (as shown by the double-headed arrows at either end of the pivot suspension 16 in FIG. 4). The pivoting occurs between the channel 20, with respect to the floor F, and the floor cleaning or burnishing machine frame 18.

FIG. 3 shows (in hidden line form) where the pivot suspension 16 of FIG. 2 is be disposed at the rear of the floor cleaning or burnishing machine 10. However, on some floor cleaning or burnishing machines, for which the pivot suspension 16 could be applied, the pivot suspension 16 may be disposed between the front and rear, or possibly toward the front of a particular floor cleaning or burnishing machine.

The floor cleaning or burnishing machine 10 of FIG. 1 presents a likely embodiment for the pivot suspension 16, when it has four points of contact with the floor F, but when the floor cleaner or burnisher 11 is not in contact with the floor F. Then, two casters 14 are in the front and two wheels 12 are in the rear of the floor cleaning or burnishing machine 10. Upon encountering an uneven portion of a floor F, a thick piece of debris or dirt, or the like, the pivot suspension 16 pivots away from being horizontal with the floor F while both wheels 12 remain in significant contact with the floor F. Thus, the pivot suspension 16 does not to allow either of the wheels to spin, nor to allow either or both of the wheels 12 to lose significant traction. Thereby, in combination with at least one caster, the floor cleaning or burnishing machine 10 presents at least a three point stance with the floor. Consequently, the floor cleaning or burnishing machine 10 does not allow tipping, misdirection, loss of significant contact with the floor F, nor sudden bursting of the floor cleaning or burnishing machine 10 when unexpected contact to the floor is suddenly returned.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed is:

1. A floor cleaning or burnishing machine comprising:

a pivot suspension, comprising:

at least two separate rear drive wheels;

a channel having two ends and axially extending across a rigid frame of a floor cleaning or burnishing machine, wherein a first of the rear drive wheels is rotatably attached to a first end of the channel and a second of the rear drive wheels is rotatably attached to a second end of the channel; and a pivot rod disposed in line from front to rear of the floor cleaning or burnishing machine, pivotably connected to the ridged frame of the floor cleaning or burnishing machine, and fixedly attached to the channel at a location between the two ends of the channel, so that the rear drive wheels are in a pivotable relationship with the ridged frame of the floor cleaning or burnishing machine.

2. The floor cleaning or burnishing machine of claim 1 wherein the channel is hollow.

3. The floor cleaning or burnishing machine of claim 1 wherein the pivot rod is connected at both ends thereof, by separate bearings.

* * * * *